US006227190B1

(12) United States Patent
Glass

(10) Patent No.: US 6,227,190 B1
(45) Date of Patent: May 8, 2001

(54) FIREPLACE FIRE STARTING DEVICE

(76) Inventor: Michael J. Glass, 1625 Sunnyside Ave., Stockton, CA (US) 95205

( * ) Notice: Subject to any disclaimer, the term of this patent is extended or adjusted under 35 U.S.C. 154(b) by 0 days.

(21) Appl. No.: 09/586,359

(22) Filed: Jun. 2, 2000

(51) Int. Cl.[7] ..... A47J 37/00; F24B 3/00
(52) U.S. Cl. ..... 126/25 B; 431/331
(58) Field of Search ..... 126/25 R, 25 B, 126/45, 46, 44, 41 R, 9 R, 43, 1 R, 500, 512; 431/315, 331

(56) References Cited

U.S. PATENT DOCUMENTS 3,890,952 * 6/1975 Hamre ..... 126/45
4,150,610 * 4/1979 Ferrara ..... 126/25 R
4,487,572 * 12/1984 Parker ..... 126/25 B

FOREIGN PATENT DOCUMENTS

486506 * 4/1918 (FR) ..... 126/25 B

* cited by examiner

*Primary Examiner*—James C. Yeung

(57) ABSTRACT

A fireplace fire starting device for efficiently starting campfires and fireplace fires. The fireplace fire starting device includes a housing. The housing comprises a shaft, which is elongate and has a first end and a second end. A peripheral wall extends between and is integrally coupled to the first and second ends. The shaft has a lumen therein. The peripheral wall has a plurality of openings therein. Each of the openings extends into the lumen, and each of the openings is generally aligned. Burning oil is placed in the lumen. The shaft is placed in a fireplace under the wood grill, and the burning oil in the lumen is lit such that flames escape upwards and ignite wood on the wood supporting grill.

11 Claims, 2 Drawing Sheets

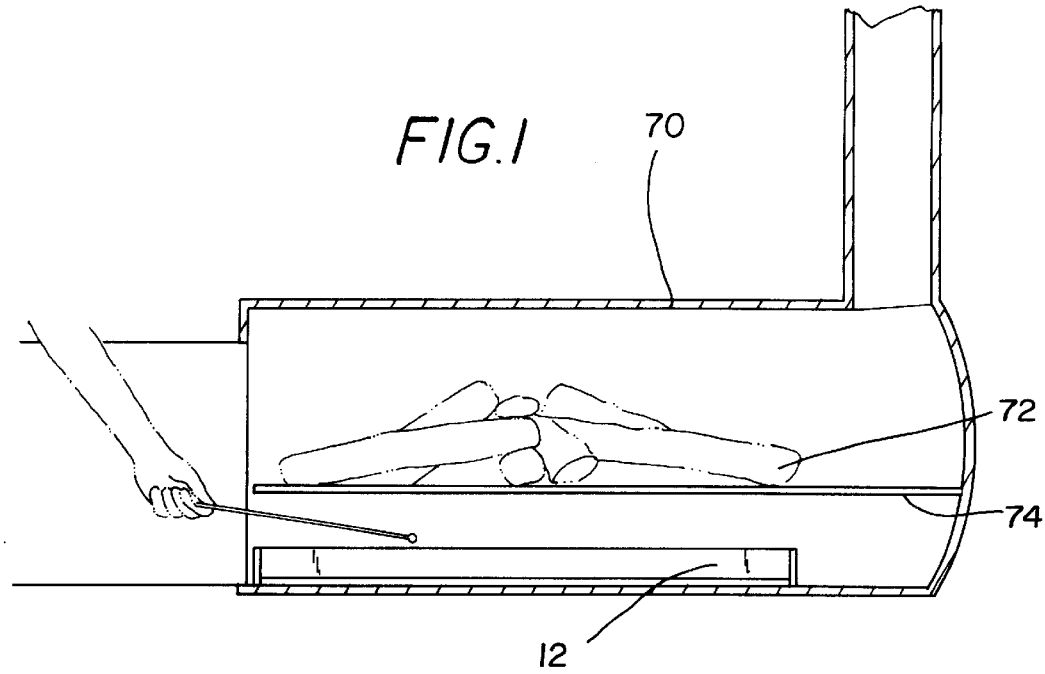
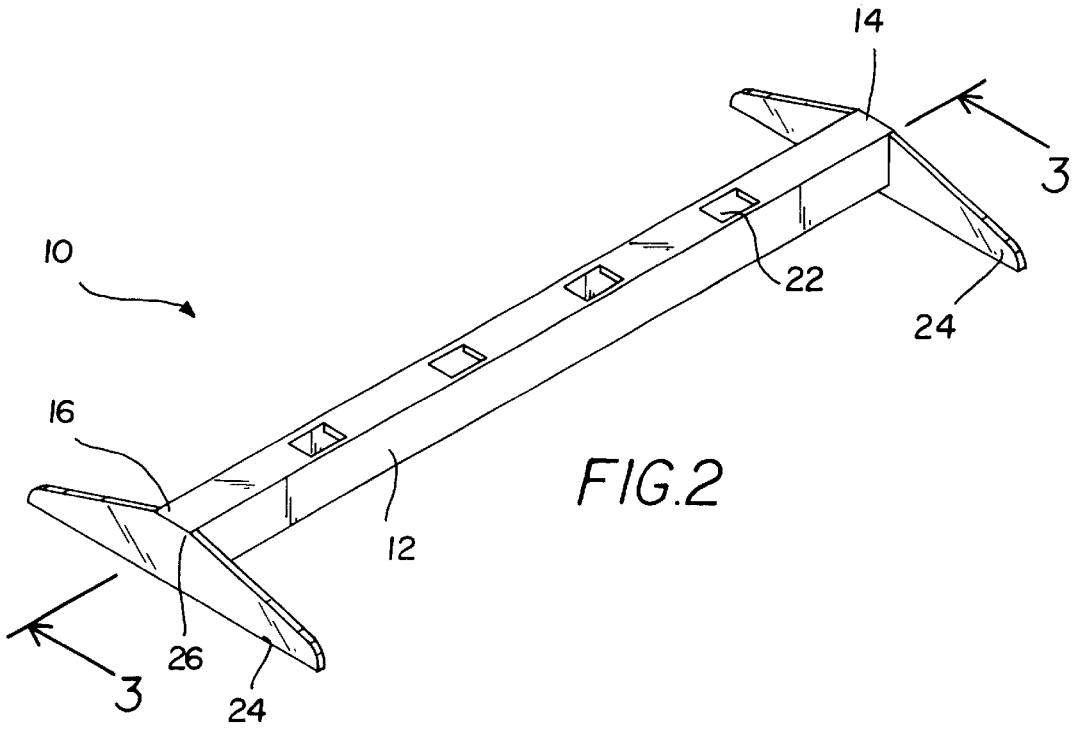
FIG.2

FIREPLACE FIRE STARTING DEVICE

BACKGROUND OF THE INVENTION

1. Field of the Invention

The present invention relates to fire starting devices and more particularly pertains to a new fireplace fire starting device for efficiently starting campfires and fireplace fires.

2. Description of the Prior Art

The use of fire starting devices is known in the prior art. More specifically, fire starting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,487,572; U.S. Pat. No. 725,993; U.S. Pat. No. 4,779,608; Des. U.S. Pat. No. 356,008; U.S. Pat. No. 4,756,719; and U.S. Pat. No. 5,743,248.

While these devices fulfill their respective, particular objectives and requirements, the aforementioned patents do not disclose a new fireplace fire starting device. The inventive device includes a housing. The housing comprises a shaft, which is elongate and has a first end and a second end. A peripheral wall extends between and is integrally coupled to the first and second ends. The shaft has a lumen therein. The peripheral wall has a plurality of openings therein. Each of the openings extends into the lumen, and each of the openings is generally aligned. Burning oil is placed in the lumen. The shaft is placed in a fireplace under the wood grill, and the burning oil in the lumen is lit such that flames escape upwards and ignite wood on the wood supporting grill.

In these respects, the fireplace fire starting device according to the present invention substantially departs from the conventional concepts and designs of the prior art, and in so doing provides an apparatus primarily developed for the purpose of efficiently starting campfires and fireplace fires.

SUMMARY OF THE INVENTION

In view of the foregoing disadvantages inherent in the known types of fire starting devices now present in the prior art, the present invention provides a new fireplace fire starting device construction wherein the same can be utilized for efficiently starting campfires and fireplace fires.

The general purpose of the present invention, which will be described subsequently in greater detail, is to provide a new fireplace fire starting device apparatus and method which has many of the advantages of the fire starting devices mentioned heretofore and many novel features that result in a new fireplace fire starting device which is not anticipated, rendered obvious, suggested, or even implied by any of the prior art fire starting devices, either alone or in any combination thereof.

To attain this, the present invention generally comprises a housing. The housing comprises a shaft, which is elongate and has a first end and a second end. A peripheral wall extends between and is integrally coupled to the first and second ends. The shaft has a lumen therein. The peripheral wall has a plurality of openings therein. Each of the openings extends into the lumen, and each of the openings is generally aligned. Burning oil is placed in the lumen. The shaft is placed in a fireplace under the wood grill, and the burning oil in the lumen is lit such that flames escape upwards and ignite wood on the wood supporting grill.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fireplace fire starting device apparatus and method which has many of the advantages of the fire starting devices mentioned heretofore and many novel features that result in a new fireplace fire starting device which is not anticipated, rendered obvious, suggested, or even implied by any of the prior art fire starting devices, either alone or in any combination thereof.

It is another object of the present invention to provide a new fireplace fire starting device which may be easily and efficiently manufactured and marketed.

It is a further object of the present invention to provide a new fireplace fire starting device which is of a durable and reliable construction.

An even further object of the present invention is to provide a new fireplace fire starting device which is susceptible of a low cost of manufacture with regard to both materials and labor, and which accordingly is then susceptible of low prices of sale to the consuming public, thereby making such fireplace fire starting device economically available to the buying public.

Still yet another object of the present invention is to provide a new fireplace fire starting device which provides in the apparatuses and methods of the prior art some of the advantages thereof, while simultaneously overcoming some of the disadvantages normally associated therewith.

Still another object of the present invention is to provide a new fireplace fire starting device for efficiently starting campfires and fireplace fires.

Yet another object of the present invention is to provide a new fireplace fire starting device which includes a housing. The housing comprises a shaft, which is elongate and has a first end and a second end. A peripheral wall extends between and is integrally coupled to the first and second ends. The shaft has a lumen therein. The peripheral wall has a plurality of openings therein. Each of the openings extends into the lumen, and each of the openings is generally aligned. Burning oil is placed in the lumen. The shaft is placed in a fireplace under the wood grill, and the burning oil in the lumen is lit such that flames escape upwards and ignite wood on the wood supporting grill.

Still yet another object of the present invention is to provide a new fireplace fire starting device that quickly starts a fire without the need for finding kindling or other material.

Even still another object of the present invention is to provide a new fireplace fire starting device that starts a fire in a more efficient way than simply applying fuel or burning oil to wood which often necessitates the application of additional fuel.

Still yet another object of the present invention is to provide a new fire starting device in which the amount of oil may be varied in order to accommodate the time required to ignite the wood.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic side in-use view of a new fireplace fire starting device according to the present invention.

FIG. 2 is a schematic perspective view of the present invention.

DESCRIPTION OF THE PREFERRED EMBODIMENT

Figure 3:
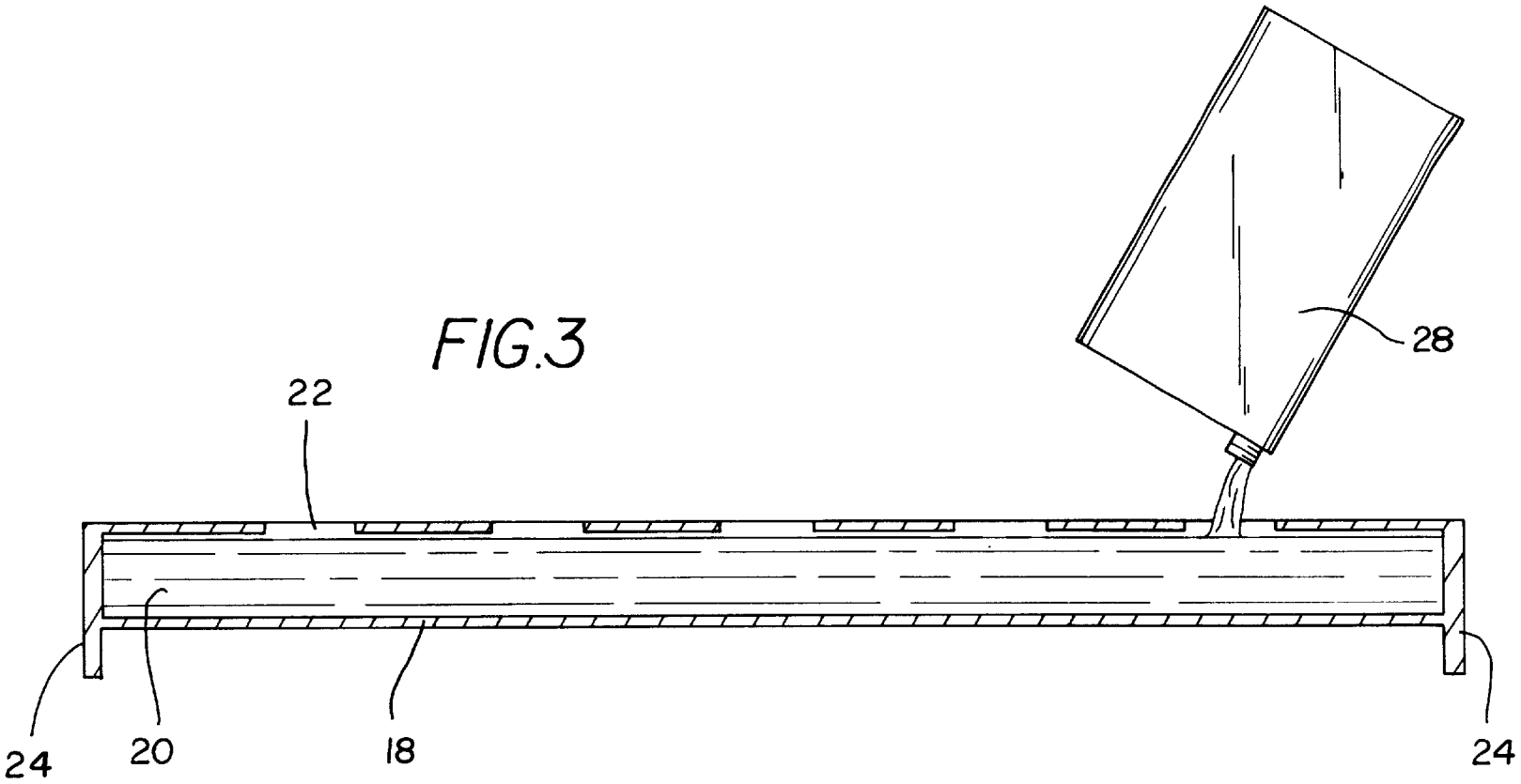
FIG. 3 is a schematic side cross-sectional view taken along line 3—3 of the present invention.

With reference now to the drawings, and in particular to FIGS. 1 through 3 thereof, a new fireplace fire starting device embodying the principles and concepts of the present invention and generally designated by the reference numeral 10 will be described.

As best illustrated in FIGS. 1 through 3, the fireplace fire starting device 10 generally comprises a housing 12. The housing 12 comprises a shaft. The housing 12, hereinafter also referred to as shaft, is elongate and has a first end 14 and a second end 16. A peripheral wall 18 extends between and is integrally coupled to the first 14 and second 16 ends. The shaft 12 has a lumen 20 therein. The peripheral wall 18 has a plurality of openings 22 therein. Each of the openings 22 extends into the lumen 20, and each of the openings 22 is generally aligned. Each of the openings 22 has a generally rectangular shape. The shaft 12 preferably comprises a metal. The shaft 12 has a generally rectangular shape. The shaft has a length generally between 12 and 24 inches, a height generally between ½ inch and 2 inches and a width generally between ½ inch and 1 inch.

A pair of support members 24 supports the housing 12 above a bottom wall of the fireplace. Each of the support members 24 is integrally coupled to one of the ends 14, 16 of the shaft 12. Each of the support members 24 forms a leg that extends away from the shaft 12 in an opposite direction of the openings 22 such that the openings 22 are directed upwards when a bottom edge of the legs are abutted against the bottom of a fireplace 70. Each of the support members 24 is generally rectangular shaped, and each of the support members is generally planar. The support members 24 are in planes orientated generally perpendicular to a longitudinal axis of the shaft 12. Each of the support members is positioned such that an apex 26 of each triangle is abutted against the shaft 12.

Burning oil 28, or other flammable liquid, is placed in the lumen 20. Virtually any burning oil 28 may be used and the selection will depend on the type of wood 72 to be burned. For quick igniting wood, highly volatile oil may be used. For wood which requires sustained heat, slower burning oils should be used. The burning oil 28 preferably comprises kerosene.

In use, the burning oil 28 in the lumen 20 using a funnel or some other similar means. The shaft 12 is placed under the wood 72 and the oil 28 is lit such that flames escape upwards and ignite wood 72 on the wood supporting grill 74. The device 10 may also be used to start campfires. In that instance, a pyramid of wood is preferably erected with the device in the center of the pyramid. The oil in the device 12 is then lit which ignites the wood.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fireplace fire starting device, the device being placeable under a wood supporting grill within a fireplace, the device being capable of holding burning oil, said device comprising:

a housing comprising a shaft, said shaft being elongate and having a first end and a second end, a peripheral wall extending between and being integrally coupled to said first and second ends, said shaft having a lumen therein, said peripheral wall having a plurality of openings therein adapted for receiving a flammable liquid, each of said openings extending into said lumen; and wherein each of said plurality of openings has a width substantially equal to a width of said lumen of said shaft, said plurality of openings being adapted for providing flame to the wood in a variety of locations to insure ignition of the wood.

2. The fireplace fire starting device as in claim 1, wherein said shaft has a generally rectangular shape, said shaft having a length substantially equal to 18 inches, a height generally between ½ inch and 2 inches and a width generally between ½ inch and 1 inch.

3. The fireplace fire starting device as in claim 2, further comprising:

a pair of support members for supporting said housing above a bottom wall of said fireplace, each of said support members being integrally coupled to one of said ends of said shaft, each of said support members forming a leg extending away from said shaft in an opposite direction of said openings such that said openings are directed upwards when a bottom edge of said legs are abutted against said bottom wall of said fireplace.

4. The fireplace fire starting device as in claim 3, wherein each of said support members is generally rectangular shaped, each of said support members being generally planar, said support members being in planes orientated generally perpendicular to a longitudinal axis of said shaft, each of said support members being positioned such that an apex of each triangle is abutted against said shaft.

5. The fireplace fire starting device as in claim 1, further comprising:

a pair of support members for supporting said housing above a bottom wall of said fireplace, each of said support members being integrally coupled to one of said ends of said shaft, each of said support members forming a leg extending away from said shaft in an opposite direction of said openings such that said openings are directed upwards when a bottom edge of said legs are abutted against said bottom of said fireplace.

6. The fireplace fire starting device as in claim 5, wherein each of said support members is generally rectangular shaped, each of said support members being generally planar, said support members being in planes orientated generally perpendicular to a longitudinal axis of said shaft, each of said support members being positioned such that an apex of each triangle is abutted against said shaft.

7. The fireplace fire starting device as in claim 1, wherein said openings are located on an uppermost portion of said peripheral wall.

8. The fireplace fire starting device as in claim 1, wherein said openings are uniformly spaced along said peripheral wall of said housing.

9. The fireplace fire starting device as in claim 1, wherein four openings are provided.

10. A method of starting a fire in a fireplace, the fireplace having a wood supporting grill therein, said method comprising steps of:

providing a fire starting device, the device comprising a housing, said housing comprising a shaft, said shaft being elongate and having a first end and a second end, a peripheral wall extending between and being integrally coupled to said first and second ends, said shaft having a lumen therein, said peripheral wall having a plurality of openings therein, each of said openings extending into said lumen, each of said openings being generally aligned, each of said openings having a generally rectangular shape, each of said plurality of openings having a width substantially equal to a width of said lumen of said shaft, said plurality of openings being adapted for providing flame to the wood in a variety of locations to insure ignition of the wood, a pair of support members for supporting said housing above a bottom wall of said fireplace, each of said support members being integrally coupled to one of said ends of said shaft, each of said support members forming a leg extending away from said shaft in an opposite direction of said openings such that said openings are directed upwards when a bottom edge of said legs are abutted against said bottom of said fireplace;

providing burning oil;

pouring said burning oil in said lumen through one of said openings;

placing said shaft under the grill;

placing wood on the grill;

lighting said burning oil such that flames exit said lumen through said openings; and igniting of said wood by said flames.

11. A fireplace fire starting device, the device being placeable under a wood supporting grill within a fireplace, said device comprising:

a housing, said housing comprising a shaft, said shaft being elongate and having a first end and a second end, a peripheral wall extending between and being integrally coupled to said first and second ends, said shaft having a lumen therein, said peripheral wall having a plurality of openings therein, each of said openings extending into said lumen, each of said openings being generally aligned, each of said openings having a generally rectangular shape, said shaft comprising a metal, said shaft having a generally rectangular shape, said shaft having a length substantially equal to 18 inches, a height generally between ½ inch and 2 inches and a width generally between ½ inch and 1 inch;

a pair of support members for supporting said housing above a bottom wall of said fireplace, each of said support members being integrally coupled to one of said ends of said shaft, each of said support members forming a leg extending away from said shaft in an opposite direction of said openings such that said openings are directed upwards when a bottom 9 edge of said legs are abutted against said bottom of said fireplace, each of said support members being generally rectangular shaped, each of said support members being generally planar, said support members being in planes orientated generally perpendicular to a longitudinal axis of said shaft, each of said support members being positioned such that an apex of each triangle is abutted against said shaft;

burning oil, said burning oil being placed in said lumen, said burning oil comprising kerosene;

wherein said burning oil in said lumen is lit such that flames escape upwards and ignite wood on said wood supporting grill;

wherein each of said plurality of openings have a width substantially equal to a width of said lumen of said shaft, said plurality of openings being adapted for providing flame to the wood in a variety of locations to insure ignition of the wood;

wherein said openings are located on an uppermost portion of said peripheral wall;

wherein said openings are uniformly spaced along said peripheral wall of said housing; and wherein four openings are provided.

* * * * *